United States Patent [19]

Beuchat

[11] 4,116,133

[45] Sep. 26, 1978

[54] ELECTRONIC FIRING DEVICE FOR MISSILES

[75] Inventor: Roger Beuchat, Gland, Switzerland

[73] Assignee: Mefina S.A., Fribourg, Switzerland

[21] Appl. No.: 742,422

[22] Filed: Nov. 17, 1976

[30] Foreign Application Priority Data

Nov. 25, 1975 [CH] Switzerland ..... 15240/75

[51] Int. Cl.[2] ..... F42C 11/06; F42C 9/00

[52] U.S. Cl. ..... 102/215; 102/266

[58] Field of Search ..... 102/70.2 R

[56] References Cited

U.S. PATENT DOCUMENTS

| | | | |
|---|---|---|---|
| 3,106,160 | 10/1963 | Harnau et al. | 102/70.2 R |
| 3,500,746 | 3/1970 | Ambrosini | 102/70.2 R |
| 3,646,371 | 2/1972 | Flad | 102/70.2 R |
| 3,670,652 | 6/1972 | Ziemba | 102/70.2 R |
| 3,672,302 | 6/1972 | Shaw | 102/70.2 R |
| 3,750,583 | 8/1973 | White et al. | 102/70.2 R |
| 3,760,732 | 9/1973 | Schuster et al. | 102/70.2 R |
| 3,844,217 | 10/1974 | Ziemba | 102/70.2 R |
| 3,958,510 | 5/1976 | Stutzle | 102/70.2 R |
| 4,026,215 | 5/1977 | Ziemba et al. | 102/70.2 R |

*Primary Examiner*—Charles T. Jordan
*Attorney, Agent, or Firm*—Emory L. Groff, Jr.

[57] ABSTRACT

An electronic firing device of a missile, enabling precise setting of a time delay from several milliseconds up to an hour or more, comprises an energy accumulator formed by a capacitor associated with an energy receiving coil charging the capacitor from an external signal. This signal has a low frequency energy-supply component and a high frequency signal having a series of pulse trains defining a decimal number up to, for example, $10^7$. The high frequency signal passes via a coded selective filter supplying, to a memory, a coded value defining a time delay. An oscillator triggered by a security switch supplies clock signals which are divided to provide 1 millisecond pulses counted in a coding circuit in the same code as the memory. This coding circuit and the memory are connected to a comparator which supplies a firing signal when the count reaches the memorized value.

2 Claims, 1 Drawing Figure

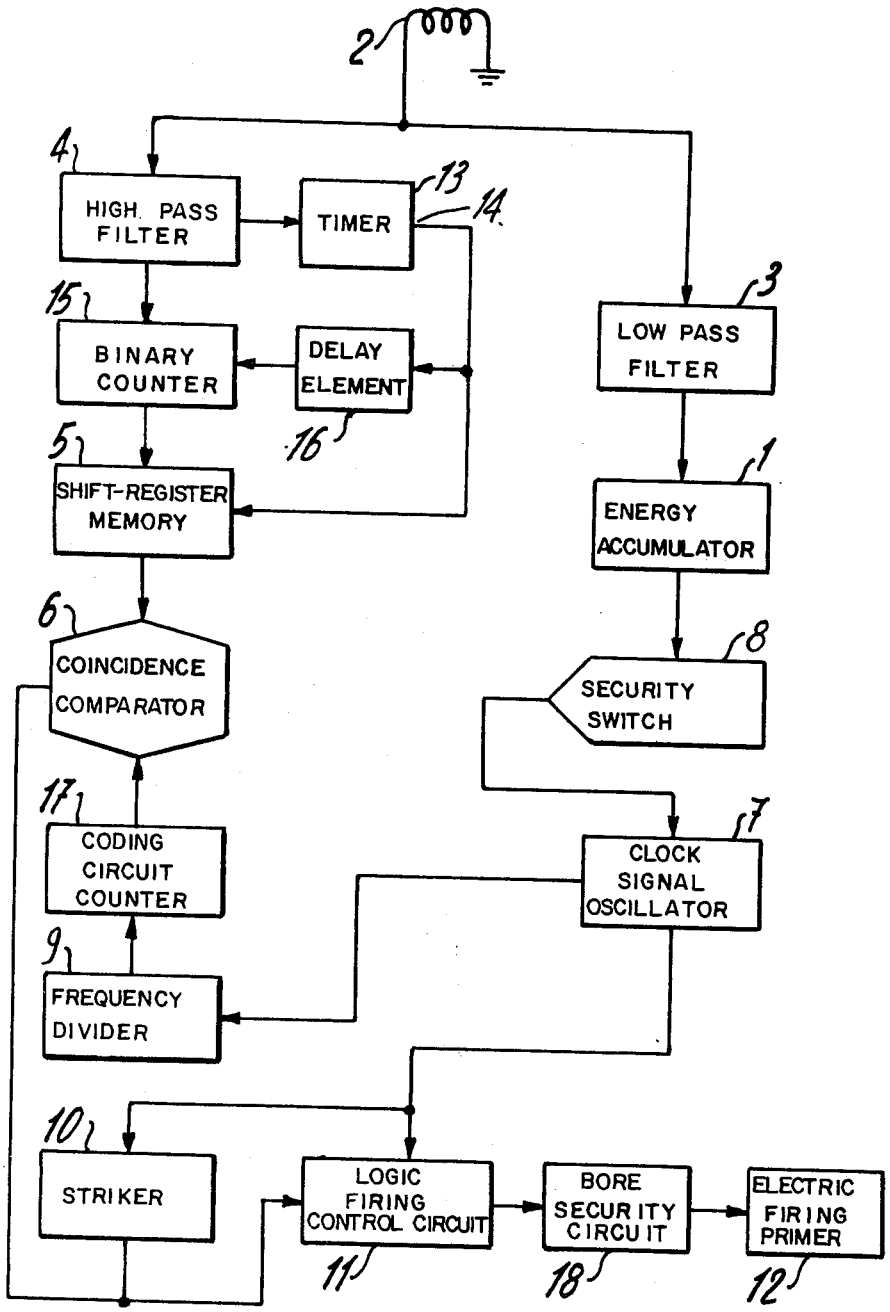
2
4
HIGH PASS FILTER
TIMER
13
14
15
BINARY COUNTER
DELAY ELEMENT
16
3
LOW PASS FILTER
5
SHIFT-REGISTER MEMORY
1
ENERGY ACCUMULATOR
6
COINCIDENCE COMPARATOR
8
SECURITY SWITCH
17
CODING CIRCUIT COUNTER
7
CLOCK SIGNAL OSCILLATOR
9
FREQUENCY DIVIDER
10
STRIKER
LOGIC FIRING CONTROL CIRCUIT
11
BORE SECURITY CIRCUIT
18
ELECTRIC FIRING PRIMER
12

ELECTRONIC FIRING DEVICE FOR MISSILES

There are already known electronic firing devices for missiles, comprising a source of energy, means for applying the energy to an electric primer, these application means comprising an adjustable time-delay device for controlling firing after a determined time interval counted from the appearance of a control signal, an electronic memory for storing a value defining said time interval, and an input circuit intended to receive a signal representing said time interval.

An aim of the invention is to enable a precise setting of the time delay within a wide range, for example from values as small as several milliseconds to values of an hour or more.

The device according to the invention is characterized in that a circuit comprises a coded selective filter supplying to a memory a coded signal defining said time interval, and also comprises an oscillator supplying clock signals, a coding circuit receiving the clock signals and transforming them into the same code as that of said coded signal applied to the memory, and a comparator connected to the memory and to the coding circuit to supply a firing signal when there is a coincidence.

The single FIGURE of the accompanying drawings is a simplified electric block diagram of an embodiment of the invention.

The described firing device consists principally of electronic elements which require a power supply. For this purpose, the firing device comprises an energy source induced in a coil 2 and an energy accumulator 1 such as a capacitor which is charged by the energy induced in coil 2 before the missile is fired. The energy stored in the accumulator 1 is supplied by an energy signal induced in a coil 2 by a magnetic field supplied by a transmitter external to the missile. The energy signal is an alternating signal of a given frequency, for example of the order of 50 Hz; this signal passes through a low-pass filter 3 to the energy accumulator 1 which, of course, comprises rectifying elements so as to form a d.c. source.

The energy signal induced in coil 2 includes coded signals defining the desired time delay for the missile. These time-delay signals are produced at a much greater frequency than the energy signal and pass through a filter 4 which prevents passage of the energy signal. Filter 4 is a high-pass filter whose cut-off frequency may be about 500 Hz if the time-delay signals have a frequency of several kHz.

The firing device is arranged so that the time-delay of the missile can be set precisely and within a wide range. The time-delay signal defines this delay by a given number of pulses which are transmitted superimposed on a signal having the frequency of the energy signal. Hence, during the time of one pulse of the energy signal, for example 10 ms, a signal defining the desired time-delay is transmitted, in the form of coded pulses, to a memory formed by a shift-register 5.

To allow selection of the time delay within as wide a range as that mentioned above, without having to use electronic components which are too bulky, the time-delay signal is sent in a suitable coded form.

This time-delay signal is thus formed by trains of pulses spaced apart from one another by a given time, for example 100 milliseconds. Each train comprises from one to ten pulses to define a number from 0 to 9. These pulses are supplied on the one hand to shift-register 5 and on the other hand to a timer 13 which may b formed by a monostable flip-flop of which the instabi ity time is less than 100 milliseconds (for example 70 m but greater than the time interval separating two adj cent pulses of the same train. In this manner, this monc stable flip-flop is brought to its unstable state by the fir pulse of a train and is held in this state by each of th following pulses of the same train. At the end of th train, the interval of 100 ms allows the flip-flop 13 t reassume its stable state and deliver a pulse at its outpu 14 which controls transfer into shift register 5.

The signal which passes through the filter 4 pilots binary counter whose output is connected to shift regi ter 5. This counter 15 also has a zero-setting termin which is connected to the output 14 of timer 13 via delay element 16 which, at the end of a train, provide a zero-setting signal with a delay of several millisecond required to allow introduction into the register 5 of th number counted by counter 15 before it is reset to zerc Shift register 5 must, of course, have as many transfe steps (stages) as the time-delay signal may have train i.e. decimal ranks (units, tens, hundreds, etc.). A shi register comprising seven stages enables the storage of time delay with a precision of 1 millisecond and a maxi mum duration exceeding two hours.

The output of register 5 is delivered to an input of coincidence comparator 6. Another input of compara tor 6 receives a signal obtained from an oscillator supplied by d.c. source 1 via a security switch 8. Th latter may be an inertia switch which applies the volt age of source 1 to the oscillator 7 as soon as the missil is shot.

The output signal of oscillator 7 is applied to a fre quency divider 9, to a striker-switch circuit 10 sensitiv to impact of the missile, and to a logic firing contrc circuit 11.

Circuit 11 is connected to an electric firing primer 1 via a circuit 18 providing a mouth or bore security Circuit 18 may for example be formed of a switch whic is normally closed but opens in response to the accelera tion of the missile when it is shot.

The division ratio of divider 9 is selected as a functio of the frequency of oscillator 7 to deliver pulses at th rate of one each millisecond. These output pulses c divider 9 are delivered to a counter or coding circuit 1 which counts the pulses in the same code as that of th shift register 5. Hence, as soon as the oscillator 7 start the counter or coding circuit 17 begins to function an when the number of milliseconds counted correspond to the number stored in register 5, the comparator supplies a firing signal to circuit 11.

To be able to provide long time delays, for exampl up to an hour, and to avoid having to provide a dry ce or equivalent energy source for the ignition device, a of the circuits used must have a very low consumptio It is thus possible to provide the energy source in th form of a simple capacitor which, before the missile shot, is charged with a charge sufficient to supply th electronic circuits of the firing device. To reduce th current consumption as far as possible, shift register 5 of a type comprising means for cutting off and trigge ing its output signal. Delivery of the output signal register 5 may be controlled by the oscillator 7 or sec rity switch 8 so that as long as the missile has not bee shot, the register 5 has a very low current consumptio To enhance the security of the device, the circuit 1 has two inputs, one receiving the firing signal fro comparator 6 and the other the output signal of oscill tor 7, and includes logic circuitry which allows firing only if the two inputs simultaneously receive signals.

The striker switch 10 is connected in parallel with comparator 6 to permit immediate firing in the event of impact provided, of course, that the security (inertia) switch 8 and the security circuit 18 have both already operated. It would, however, be easy to provide a switch or a logic circuit enabling the striker switch 10 to be placed off-circuit, if desired. The striker switch 10 may be of any known construction, for example a striker rod or plunger which closes a contact, a piezoelectric element supplying a voltage pulse when struck, or an inertia contact. Depending on the envisaged use of the missile, it may be possible to dispense with the striker switch 10.

Of course, numerous variations may be made to the described embodiment, and the indicated values may be modified according to the requirements. The selective coded filter, which in the described example is formed by the combination of filter 4, timer (flip-flop) 13, counter 15 and delay element 16, may of course be provided in a different manner, so long as it is able to supply an unambiguous coded signal as a function of the time delay signal received.

I claim:

1. An electric firing device for missiles, comprising a source of energy, means for applying the energy to an electric primer, said applying means comprising time delay means for controlling firing after a determined time interval, counted from the appearance of a control signal, an electronic memory for storing a pulse value defining said time interval, and an input circuit to receive a signal representing said time interval, wherein said input circuit is connected to a coded selective filter supplying to the memory a coded pulse value defining said time interval, and said time delay means comprises an oscillator supplying clock signals, a coding circuit receiving the clock signals and transferring them into the same code as that of the coded signal applied to the memory, a comparator connected to the memory and to the coding circuit to supply a firing signal when there is a coincidence, said energy source supplied through said input circuit to an accumulator chargeable before use of the missile, said input circuit comprising means for receiving input signals which supply energy to the accumulator and represent said time interval, said coded selective filter being disposed between said receiving means and said memory and allowing passage to said memory of signals of relatively high frequency which represent said time interval, and a second filter disposed between said receiving means and the accumulator, said second filter allowing passage of signals of relatively low frequency which supply charging energy to the accumulator.

2. A device according to claim 1, comprising a frequency divider connected between the oscillator and the coding circuit.

* * * * *